United States Patent [19]

Gautraud

[11] 4,339,129

[45] Jul. 13, 1982

[54] MULTI-GRAPHIC MASKING UNIT

[75] Inventor: Michael G. Gautraud, Muskegon, Mich.

[73] Assignee: Brunswick Corporation, Skokie, Ill.

[21] Appl. No.: 227,788

[22] Filed: Jan. 23, 1981

[51] Int. Cl.[3] ..... A63D 5/04

[52] U.S. Cl. ..... 273/54 R; 40/601; 40/611

[58] Field of Search ..... 273/54 R; 40/601, 611; 340/323

[56] References Cited

U.S. PATENT DOCUMENTS

| | | | |
|---|---|---|---|
| 2,485,347 | 10/1949 | Anderson et al. | 273/54 R |
| 2,568,165 | 9/1951 | Oberding | 40/611 |
| 3,018,105 | 1/1962 | Grogoza | 273/54 R |
| 3,738,656 | 6/1973 | Rockwood et al. | 273/54 R |
| 3,969,838 | 7/1976 | Moore | 40/611 X |

*Primary Examiner*—Anton O. Oechsle

[57] ABSTRACT

A display device is mounted to bridge at least one bowling lane, with the support braces of a support for a frame of a panel masking unit being affixed on either side of the lane or lanes. In one embodiment, at least two panel masking units are mounted to bridge adjacent lanes, with one support brace serving as a common support for the two adjacent panel masking units. The frames are mounted on the supports for pivotal movement between a vertical and a horizontal position, with the center of gravity for each frame being close to, above and forward of the pivot mounting so as to provide easy pivoting with two stable positions, against the vertical or horizontal stops. The panels are removable, reversible and easily changed to change the design or message intended to be conveyed by the display device.

16 Claims, 11 Drawing Figures

FIG. 1
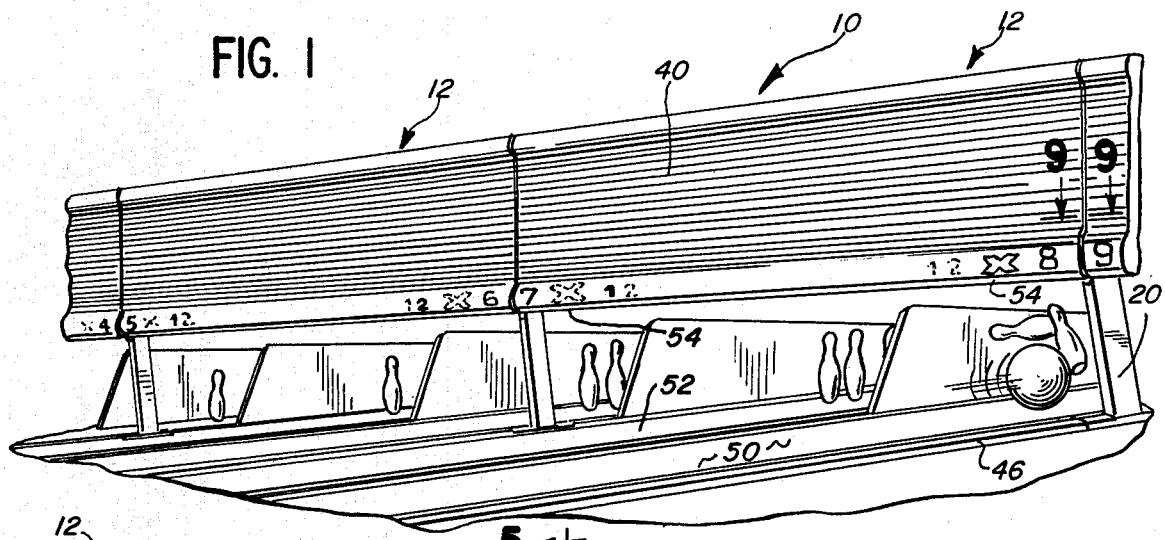
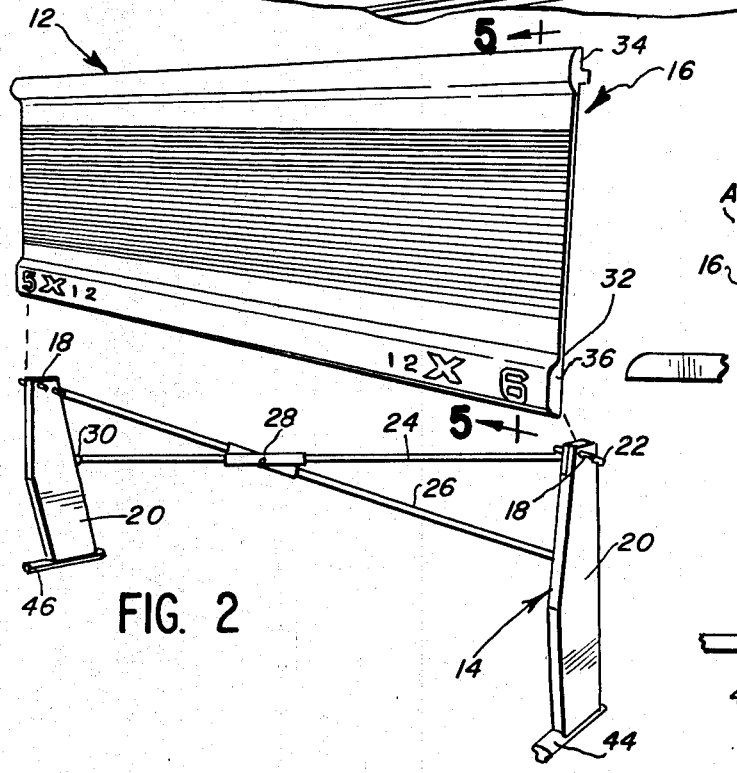
FIG. 2
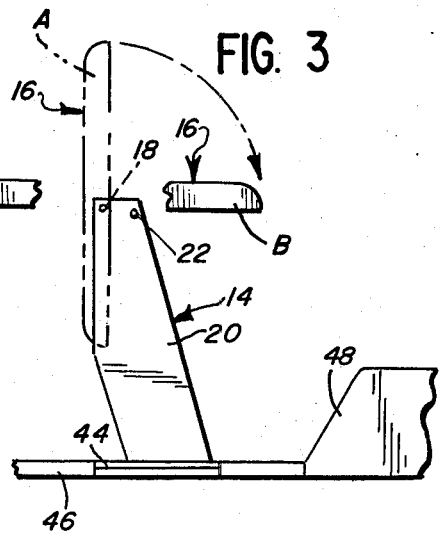
FIG. 3
FIG 4A
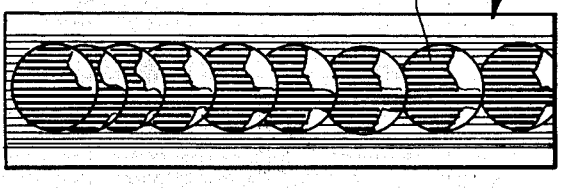
FIG 4B
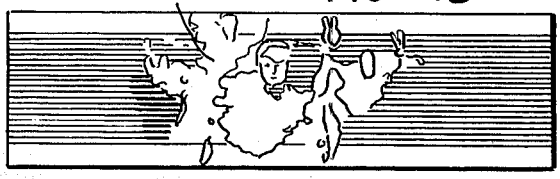
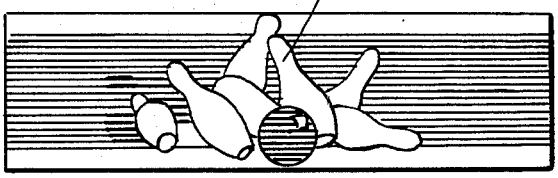
FIG. 4C

MULTI-GRAPHIC MASKING UNIT

TECHNICAL FIELD

This invention relates to display devices and, more particularly, to a pivotally mounted display device having changeable display panels.

BACKGROUND ART

In bowling alleys, there are masking units permanently affixed in front of the pinsetter machines to block out the direct view of the pinsetter machines and to provide the owner of the establishment with a display surface which can be coordinated with the remaining decor of the establishment. Heretofore, the masking units, which are the dominant surfaces for the decor because they are constantly in view of the bowlers, have been changed only periodically, such as every ten years. The only option open to the owner of the establishment was to paint the exposed surface of the display unit.

The present invention is directed to overcoming one or more of the problems as set forth above.

DISCLOSURE OF INVENTION

An improved display device is provided which has a display unit that can bridge or straddle one or more lanes of an alley and has removable and reversible display panels which can be easily changed to change the decor of the alley. One, two or more display units are mounted side-by-side to give a continuous display appearance. Each display unit has a panel masking unit and a support with the panel masking unit having a frame pivotally mounted on the support for movement between a panel display-vertical position and a service access-horizontal position.

The support has two support braces which are secured on either side of the lane or lanes being bridged by the display unit. Tie means are provided between the braces for stabilizing the support. In the embodiment wherein at least two panel display units are mounted side-by-side, three support braces are provided with the middle support brace serving as a common support brace for the adjacent display units. The display units are mounted on the supports with the edges of adjacent panels in close proximity to each other so as to avoid large spaces between panels and to hide the braces from showing therebetween.

The above and other features will be more readily understood by reference to the following detailed description and accompanying drawings.

BRIEF DESCRIPTION OF DRAWINGS

FIG. 1 is a perspective view of the novel display device incorporating the invention in position over several lanes of a bowling establishment;

FIG. 2 is a somewhat exploded perspective view of one display unit and support showing the invention;

FIG. 3 is a side elevational view of a display unit in position over a bowling lane;

FIGS. 4A, 4B, 4C are three views of different scenes that may be illustrated on a display panel;

BEST MODE FOR CARRYING OUT THE INVENTION

Figure 5:
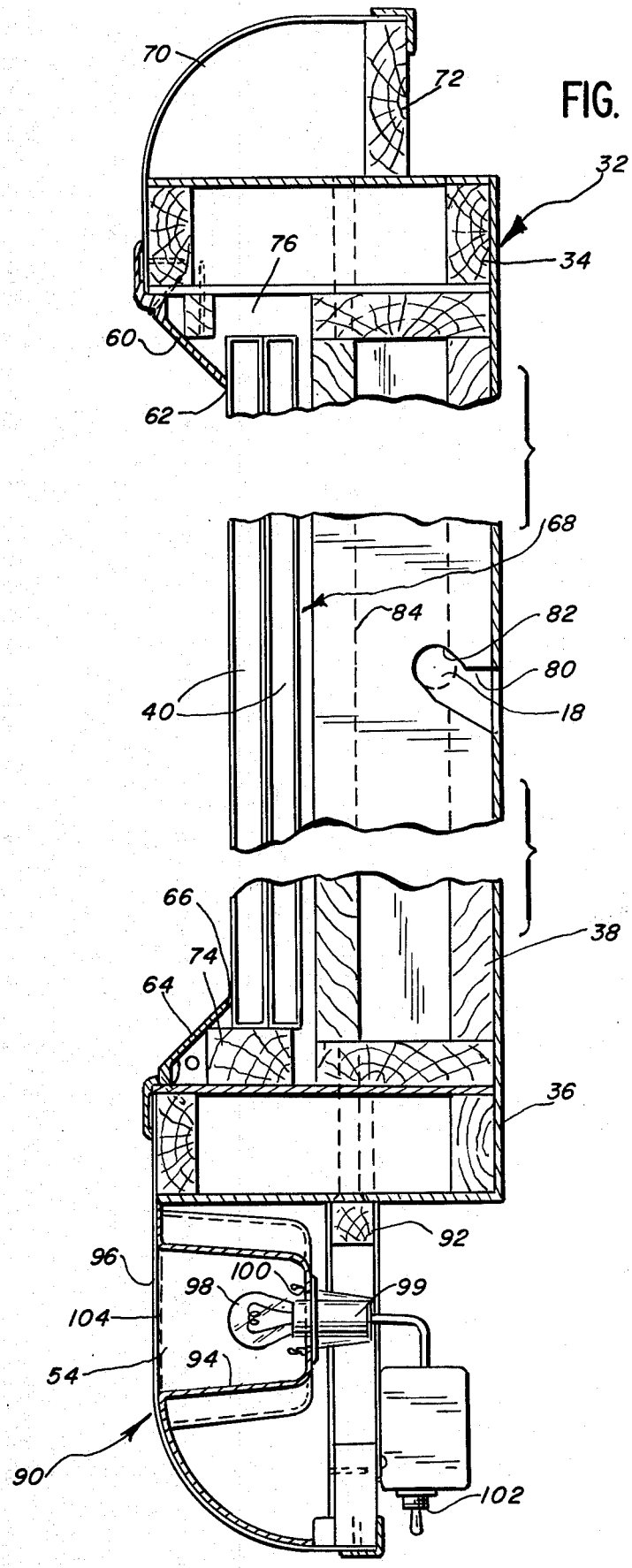
FIG. 5 is an enlarged cross-sectional view of a display unit taken along the line 5—5 of FIG. 2.

Referring to the drawing and, in particular, at the outset to FIGS. 1 to 3, inclusive, a display device 10 is illustrated and includes at least one display unit 12. Each display unit 12 is comprised of a support 14 and a panel masking unit 16 pivotally mounted together about a pair of spaced apart pivot pins 18 extending transversely through support braces 20 of said support 14. A pair of stop pins 22 extend through the support braces 20 and are located rearwardly and lower than the pivot pins 18 so that the panel masking unit 16 may be pivoted from the vertical position A to the horizontal position B, see FIG. 3, with the panel masking unit 16 resting on the stop pins 22 for a reason to be explained hereinafter.

Figure 6:
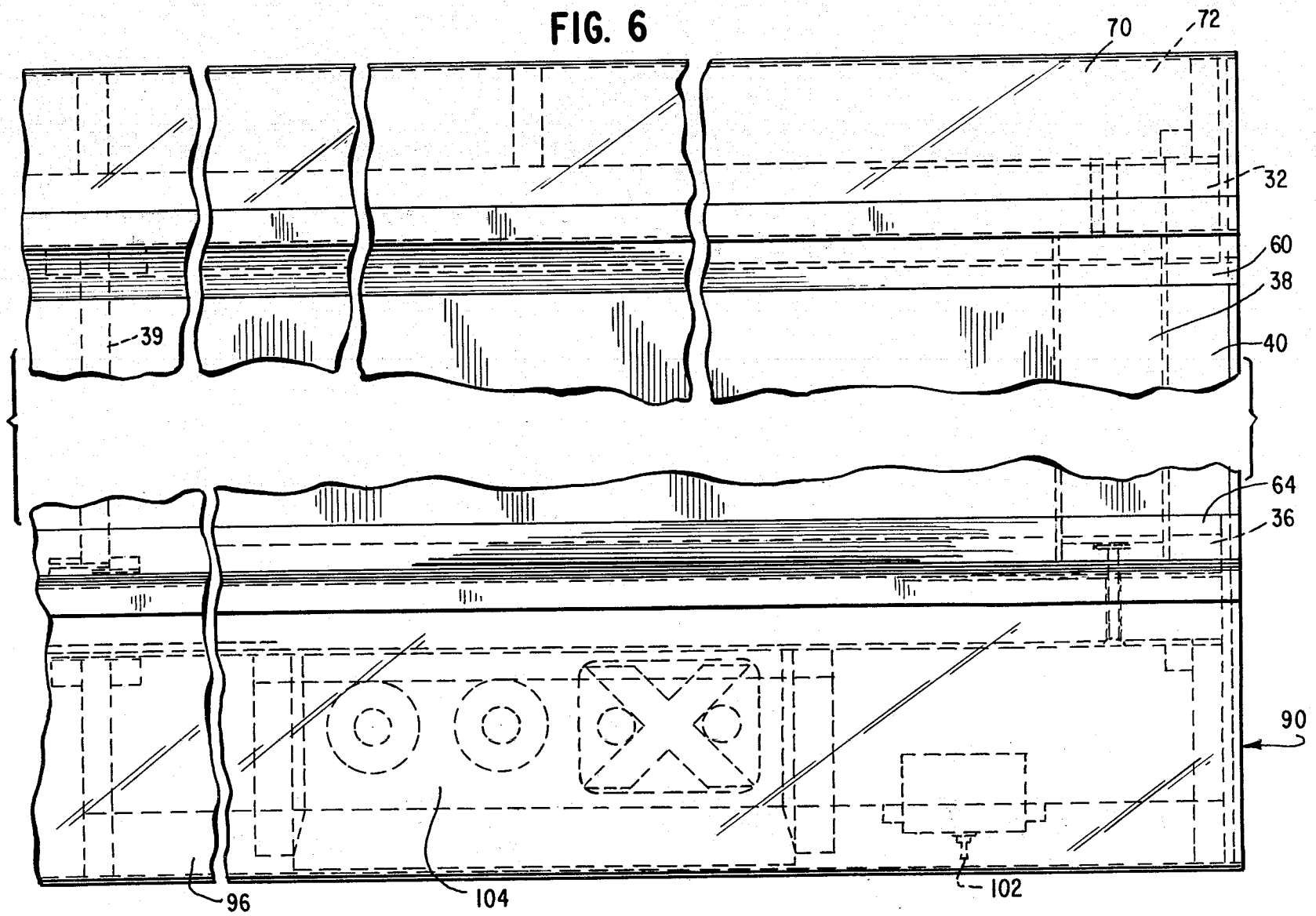
FIG. 6 is a partial elevational, broken away view of the display unit of the invention.
Figure 7:
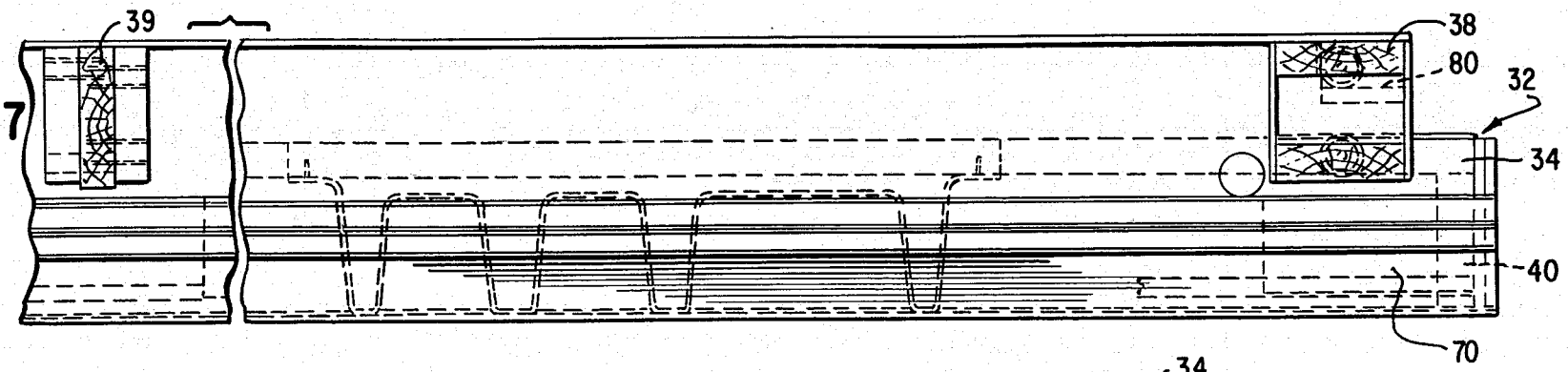
FIG. 7 is a partial top plan view of the display unit of FIG. 6.
Figure 8:
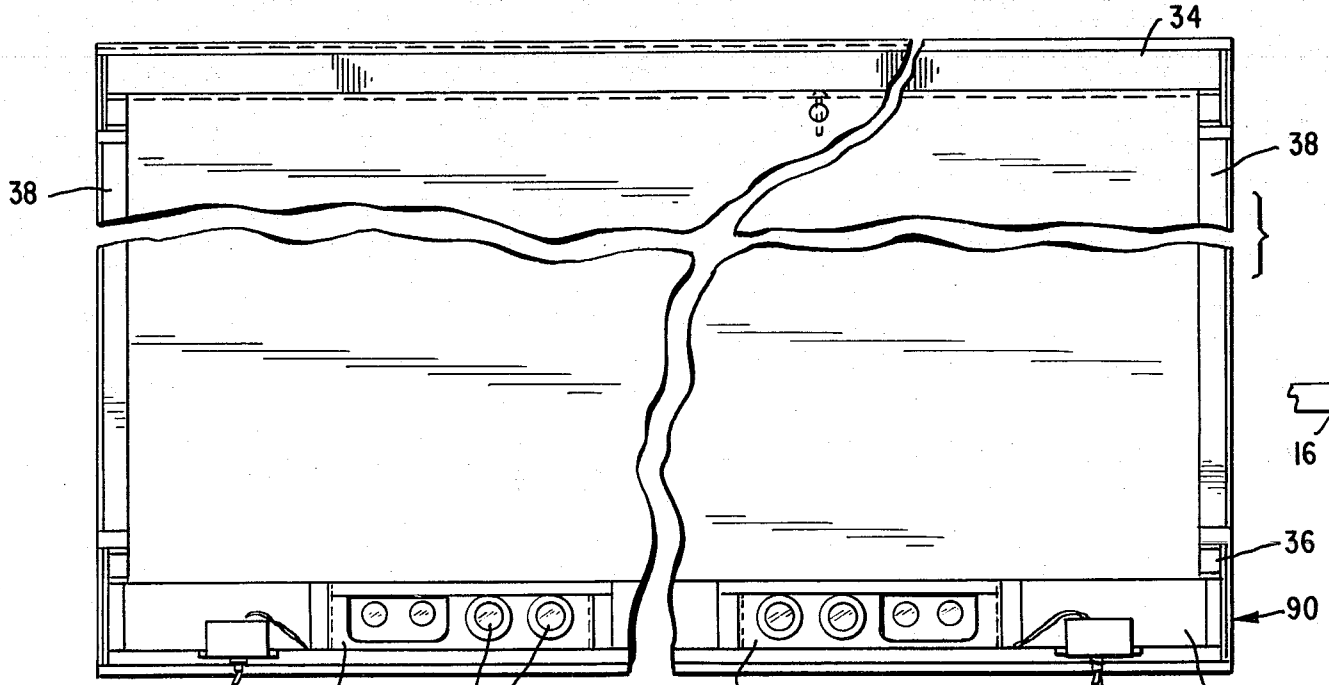
FIG. 8 is a reduced size elevational view of the display unit with the covers removed from the illumination system.

The support braces 20 are interconnected by a pair of crossed ties 24,26 which are pinned together at the cross-over point 28 and are secured to the support braces 20 by appropriate connectors 30. The ties 24,26 are mounted to the support braces 20 at a location such that the ties will be hidden by the display unit 12 when the unit 12 is in the vertical position. The ties 24,26 may be turnbuckles, or the like, for length adjustments. Each panel masking unit 16 has a frame 32 which includes a top wall 34, a bottom wall 36 and interconnected vertically disposed side bars 38, not shown in FIGS. 1-3, but are shown in FIGS. 5, 6 and 7. A pocket is formed between the top wall 34, bottom wall 36 and forward of the side bars 38 in which pocket is seated one or more display panels 40 with a display scene or view 42 facing forward of the frame 32. By pivoting the panel display unit 12 to a horizontal position, the display panel 40 can be turned over or replaced by a second display panel so as to display a different scene 42, all as will be more completely described hereinafter.

The support 14 has a foot 44 secured to each interconnected spaced apart support brace 20, which foot 44, in turn, is fastened, as by screws or the like, to a division cap 46. In a preferred embodiment, the supports 14 are secured forward of the kickback nose block 48 of the lane. As shown, each display unit 12 straddles or bridges two adjacent lanes 50,52 with an illuminated lane "number" and "first ball", "second ball", "strike" indicator 54 above the particular lane. FIG. 1 illustrates the novel feature of two or more adjacent display units 12 which give the illusion of a continuous display from lane-to-lane. The continuous display illusion is created by the unique mounting of two adjacent panel masking units 16 to a common support brace 20 with each adjacent panel masking unit 16 partially overlapping the common support brace 20.

More specifically, a preferred embodiment of the invention is shown in FIGS. 5-9 wherein one panel masking unit 16 is illustrated and has the frame 32, including the top wall 34 and the bottom wall 36. Side bars 38 extend between the top wall 34 and bottom wall 36 (FIG. 5) and are offset rearwardly of the front edges of said walls 34,36. One or more intermediate bars 39 extend between the top wall 34 and the bottom wall 36 at locations between the two side bars 38. An elongate masking member or decorative strip 60 is secured to the front edge of the top wall 34 (FIG. 5) and extends rearwardly and downwardly with respect to the top wall 34 with the rear edge 62 of the strip 60 spaced from the side bars 38 and intermediate bar 39. Likewise, a second elongate masking member or decorative strip 64 is secured to the front edge of the bottom wall 36 and extends rearwardly and upwardly with respect to the bottom wall 36 with the rear edge 66 of the strip 64 spaced from the side bars 38 and intermediate bar 39. The space between the elongate masking members 60,64 and the side bars 38 and bar 39 forms a pocket 68 which is open at both ends or sides of the frame 32. A trim strip 70 may be fastened to the front face of the top wall 34 and curves upward and back and is secured to a spacer 72 on the top wall 34. Styling effects different from the strip 70 can be incorporated in the structure without departing from the spirit of the invention.

Display panels 40, two being shown in juxtaposed relationship in FIG. 5, are seated in the pocket 68 and, once again, as shown in FIG. 5, a block 74 is located in the pocket 68 behind the masking member 64 upon which the panels 40 rest. The panels 40 have a portion overlapped by the masking member 64 and extend to a location overlapped by the masking member 60 to hold the panels 40 for display. It will be noted that a space 76 is provided between the top of the panels 40 and the bottom of the top wall 34, which space 76 is greater than the overlap of the masking member 64 so that the panels 40 and, in particular, the front panel 40 can be raised in the pocket 68, removed from the display unit 12, reversed and reinserted in the pocket. The changing of the panels 40 can be performed with the display unit 12 in the upright position of FIGS. 1 and 5. p Each display panel 40 is made of a lightweight corrugated construction and has a separate display scene or view 42 on each side thereof. With two panels 40 juxtaposed in the pocket 68, four different scenes or views 42 are possible for each display unit 12. It is to be understood that the pocket 68 may be enlarged to handle more than two panels at one time.

The frame 32 has the side bars 38 inset from the side edges of the top wall 34 and the bottom wall 36, best shown in FIGS. 6 and 7. An upwardly angled slot 80 is formed in the rear and outside edge of each side bar 38 with the slot 80 having an offset circular terminus 82 in which one pivot pin 18 seats, FIG. 5. The terminus 82 is located close to, rearward and below a center of gravity 84 shown (theoretically) in FIG. 5. With the center of gravity 84 close to, forward and above the pivot axes of the pair of pins 18 engaging in the two termini 82, the frame 32 will naturally migrate to an upright position A (FIG. 3) and must be restrained until tilted approximately 45° from the vertical. The stop pins 22 are located on the support braces 20 so that the frame 32 can be pivoted into the horizontal position. By locating the center of gravity 84, as described, rotates easily because the center of gravity 84 is close to the pivot. When the frame 32 passes the 45° position, it will naturally migrate to the horizontal position against the stop pins 22, the location of the center of gravity will hold the frame 32 in the horizontal position. There are only two stable positions, vertical and horizontal, and very light forces are required to move it from one position to the other.

An additional display feature may optionally be mounted on the frame 32 and includes a suspended housing 90 having the illuminated "first ball", "second ball", "strike" indicator 54 for each lane. The housing 90 has a bracket 92 secured to the bottom of the bottom wall 36 with a shaped holder 94 for each lane connected to the front edge of the bottom wall 36 and to the lower edge of the bracket 92. One edge of a decorative strip 96 (FIG. 5) is fastened to the front of the bottom wall 36 by a portion of the masking member 64, and the other edge is fastened to the bottom of the bracket 92 and extends the full width of the bottom wall 36, whether the frame 32 spans one, two or more lanes. There will be one holder 94 for each lane, and it will be located in the housing 90 on the frame 32 in a position to be over the lane. Four lights 98 will have sockets 99 snap fit in apertures 100 in the rear of each holder 94, with each light 98 individually actuated by a switch (not shown) on the pinsetter. In front of each holder 94, either in the form of a separate mask 104 or as an integral part of the decorative strip 96, is desirable display information, such as a number 1, a number 2 and an X. When a first ball is rolled, the number 1 is illuminated, when a second ball is rolled, the number 2 is illuminated, and when a strike is rolled, the X is illuminated. A switch 102 is located on the bracket 92 and is connected to the pinsetter to turn off the pinsetter when service access is from the front of the masking unit.

Figure 9:
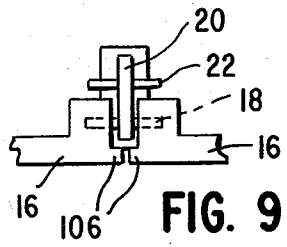
FIG. 9 is a broken away top view of two adjacent display units pivotally supported on a support brace as taken along line 9—9 of FIG. 1.

As is shown in FIG. 9, one common support brace 20, with the pivot pin 18 and stop pin 22 projecting transverse thereto, supports two adjacent panel masking units 16. Each masking unit 16 has the terminus 82 of the slot 80 of each side bar 38 of the frame 32 engaging with one end of the pivot pin 18, with the top wall 34, bottom wall 36 and panel 40 having an overlap 106 with respect to the side bar 38. The overlap 106 of each panel masking unit 16 extends forward of the support brace 20 and terminates at substantially the mid vertical plane of the support brace 20. The overlaps 106 of the adjacent panel masking units 16 substantially hide the brace 20 and, due to the relative close alignment of the masking units, creates an illusion of one continuous display across the front of several display units. By selecting panels 40, such as shown in FIGS. 4A, 4B and 4C, an action display is created. That is, by locating a panel 40, such as shown in FIG. 4B on the left, a panel 40, such as shown in FIG. 4A in the middle, and a panel 40, such as shown in FIG. 4C on the right, a complete bowling scene is created. Further illumination can be provided behind the trim strip 70 at the top portion of the display unit 12, as well as behind the lane number at the bottom portion of the display unit.

Other aspects, objects and advantages of this invention can be obtained from a study of the drawings, the disclosure and the appended claims.

I claim:

1. A display device for displaying at least one display panel comprising a support straddling at least one bowling lane forward of a kickback nose block on the lane, a panel masking unit having a frame pivotally mounted on said support, said frame having a center of gravity above and forward of the pivotal mounting so as to maintain said masking unit in an upright position, an elongate masking member projecting rearwardly and angularly from a forward edge of a top wall of said frame, a second elongate masking member projecting upwardly and angularly from a forward edge of a bottom wall of said frame, said masking member being co-terminous with the extremities of the top wall and bottom wall, said frame having a portion in spaced relation from said two masking members to form a pocket therebetween, and at least one display panel seated in said pocket with the masking members overlapping the upper and lower edge portions of said panel and with the side edges of the panel being substantially co-terminous with the extremities of the top wall and bottom wall of the frame.

2. A display device as claimed in claim 1 wherein said frame has means for pivotally engaging with said support for movement between the upright position and a horizontal position of said frame.

3. A display device as claimed in claim 1 wherein a pair of side bars extend between the top wall and the bottom wall and are spaced rearwardly of said two masking members, and wherein said side bars are spaced inward from the side extremities of the top and bottom walls to provide open ends for said pocket.

4. A display device as claimed in claims 1 or 2 wherein said side bars have means for pivotally engaging said support for movement between the upright position and a horizontal position of said frame.

5. A display device as claimed in claim 4 wherein said side bars have angled slots in which pivot pins on said support extend to provide said pivotal engagement for said frame.

6. A display device as claimed in claim 1 wherein said support includes a pair of support braces secured to lane covers on the sides of the lane, and wherein means are provided for interconnecting said support braces to stabilize said support.

7. A display device as claimed in claims 1 or 3 wherein the open-ended pocket has a space between the top of the display panel and the top wall, which space is greater than the space between the bottom wall and the innermost extremity of the second masking member whereby the panel can be raised by the pocket enough to clear the innermost extremity of the second masking member so that the panel can be swung forward and removed from the frame.

8. A display device as claimed in claim 6 wherein three support braces are secured to three spaced apart lane covers, and wherein a separate frame is pivotally mounted between two adjacent support braces, the edges of the two adjacent frames being in close proximity to each other and being supported on one support brace.

9. A display device as claimed in claims 1 or 3 wherein said pocket has a depth sufficient to secure two juxtaposed display panels therein.

10. A display device for displaying at least one display panel comprising a support straddling at least one bowling lane and having spaced apart support braces secured between adjacent lanes, means for interconnecting said support braces to stabilize said support, a panel masking unit having a frame pivotally mounted on said support braces, said frame having a top wall, a bottom wall and two spaced apart side bars connecting said top wall to said bottom wall, an elongate masking member projecting rearwardly and angularly from a forward edge of said top wall, a second elongate masking member projecting upwardly and angularly from a forward edge of said bottom wall, said masking members being co-terminous with the extremities of the top wall and bottom wall, said spaced side bars being connected to a rear portion of said top wall and said bottom wall in spaced relation from said two masking members to form an open-ended pocket therebetween, said side bars being spaced inward from the extremities of said top wall and said bottom wall, said side bars of said frame having means for engaging with said support braces for supporting said frame in a vertical position, at least one display panel seated in said pocket with the masking members overlapping the upper and lower edge portions of said panel and with the side edges of the panel being co-terminous with the extremities of the top wall and bottom wall.

11. A display device as claimed in claim 10 wherein said pocket has a space between the top edge of the panel and the top extreme of the pocket, said space being greater than the height of the lower edge portion of the panel covered by said second masking member, whereby the panel can be raised in the pocket an amount sufficient to remove the bottom of the panel from behind the second masking member so that the panel can be reversed to display the opposite side of the panel.

12. A display device as claimed in claim 10 wherein at least three support braces are secured to dividers for at least two lanes with middle support brace being between the two lanes and serving as a common brace for two supports, and wherein at least two panel masking units are supported on said two supports, at least two display panels displayed side-by-side on said at least two panel masking units.

13. A display device as claimed in claim 12 wherein said frames are pivotally mounted on said support braces for movement between said vertical position and a horizontal position.

14. A display device as claimed in claim 13 wherein said frames have a center of gravity forward of said pivotal mount so as to force said frames to the vertical position from some other angular position.

15. A display device as claimed in claim 13 wherein said frames have a center of gravity forward and above said pivotal mount so as to force said frames to either the horizontal or vertical position from some angular position in between.

16. A display device as claimed in claim 10 wherein a housing is suspended below said frame, a translucent decorative strip is disposed forward of said housing and has indicia thereon, illuminating means is mounted behind each indicia, and switch means for each illuminating means whereby the indicia can be selectively illuminated by actuating said switch.

* * * * *